US006837066B2

(12) United States Patent
Cho et al.

(10) Patent No.: US 6,837,066 B2
(45) Date of Patent: Jan. 4, 2005

(54) CONCENTRATED COOLING APPARATUS OF REFRIGERATOR

(75) Inventors: Seong-Ho Cho, Seoul (KR); In-Seop Lee, Gyeonggi-do (KR); In-Won Lee, Gyeonggi-Do (KR); Jae-Yong Sung, Seoul (KR); Jay-Ho Choi, Seoul (KR); Kwang-Hyup An, Seoul (KR); Jeong-Ho Lee, Gyeonggi-Do (KR); Young-Sok Nam, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/446,675

(22) Filed: May 29, 2003

(65) Prior Publication Data

US 2004/0016259 A1 Jan. 29, 2004

(30) Foreign Application Priority Data

Jul. 24, 2002 (KR) ..... 2002-43656

(51) Int. Cl.[7] ..... F25D 17/04
(52) U.S. Cl. ..... 62/408; 62/186
(58) Field of Search ..... 62/186, 407, 428; 236/49.2; 454/108

(56) References Cited

U.S. PATENT DOCUMENTS 5,899,090 A * 5/1999 Lyu ..... 62/408
5,974,814 A * 11/1999 Park et al. ..... 62/151
6,306,119 B1 * 10/2001 Weber et al. ..... 604/290

* cited by examiner

*Primary Examiner*—Melvin Jones
(74) *Attorney, Agent, or Firm*—Greenblum & Bernstein, P.L.C.

(57) ABSTRACT

A concentrated cooling apparatus of a refrigerator is capable of improving the reliability of an infrared sensor by preventing moisture from being condensed onto the surface of the infrared sensor. The concentrated cooling apparatus includes a nozzle rotationally supported by a cold air guide path, the nozzle intensively jetting cold air to a high-temperature load region when a high-temperature load is placed inside a chilling chamber of the refrigerator. An infrared sensor is installed at the front of the nozzle, and the infrared sensor senses the high-temperature load region while being rotated together with the nozzle. A moisture removing device is formed at a side of the nozzle, the moisture removing device jetting cold air on the surface of the infrared sensor to remove moisture condensed on the surface of the infrared sensor.

11 Claims, 5 Drawing Sheets

CONCENTRATED COOLING APPARATUS OF REFRIGERATOR

BACKGROUND OF THE INVENTION

1. Field of the Invention

The present invention relates to a refrigerator, and in particular to a concentrated cooling apparatus of a refrigerator which is capable of performing instant cooling operation by discharging cold air onto a region where a high temperature-load is located inside a chilling chamber. The present invention is also to directed to an apparatus that is capable of preventing moisture from being condensed onto the surface of an infrared sensor.

2. Description of the Prior Art

FIG. 1 is a partial-perspective view illustrating a conventional refrigerator.

The conventional refrigerator includes a main body 104 having a defined storage space including a freezing chamber 106 and a chilling chamber 108 respectively arranged on the left and right sides of the main body 104 for storing frozen food and cold food. A cold air supply apparatus is installed at the upper portion of the freezing chamber 106 and supplies cooled air while passing a refrigerant along a cooling path (not shown) into the freezing chamber 106 and the chilling chamber 108.

The cold air supply apparatus includes a fan 120 installed at the upper rear surface of the freezing chamber 106 and forcibly sending cooled air while passing the refrigerant along the cooling path. A cold air supply path 132 is formed at the upper portion of a separation wall 100 in order to make cold air sent by the fan 120 flow into the chilling chamber 108. A cold air discharge duct 134 is installed at the upper portion of the chilling chamber 108, communicates with the cold air supply path 132 and has a cold air discharge opening 136 for discharging cold air supplied from the cold air supply path 132 into the chilling chamber 108. A cold air inflow path 138 is formed at the lower portion of the separation wall 110 to make the cold air finishing the cooling operation flow into the refrigeration or cooling path.

In the conventional refrigerator, when the refrigerant is moved along the cooling path and the fan 120 is rotated, cold air cooled by passing along the refrigerant path flows into the cold air discharge duct 134 opening and is discharged into the chilling chamber 108 through the cold air discharge hole 136 of the cold air discharge duct 134. Accordingly, the cooling operation of the chilling chamber 108 is performed.

However, in the conventional refrigerator a cold air discharge duct is installed at the upper portion of a chilling chamber, and cold air is supplied from the upper portion to the lower portion of the chilling chamber through cold air discharge opening formed on the cold air discharge duct. Thus, a temperature variation inside the chilling chamber is large, as a result of a distance from the cold air discharge holes or openings to the reminder of the refrigeration chamber. Because cold air is discharged only from the cold air discharge duct, when a high temperature load occurs as a result of foodstuff stored inside the chilling chamber, etc., a long time is required for equalizing a temperature distribution inside the chilling chamber, and freshness of the foodstuff stored in the chilling chamber may be lowered due to a delay in cooling.

SUMMARY OF THE INVENTION

In order to solve the above-mentioned problem, it is an object of the present invention to provide a concentrated cooling apparatus of a refrigerator which is capable of equalizing a temperature variation inside a chilling chamber substantially instantly by installing a concentrated cooling apparatus inside the chilling chamber and intensively discharging cold air on a region where a high-temperature load is located inside the chilling chamber, maintaining freshness of foodstuff stored in the chilling chamber by improving a cooling speed on the region where the high-temperature load is located and improving the reliability of an infrared sensor by preventing moisture from being condensed onto the surface thereof.

In order to achieve the above-mentioned object, a concentrated cooling apparatus of a refrigerator in accordance with the present invention includes a nozzle rotationally supported by a cold air guide path, the nozzle intensively injecting cold air to a high-temperature load region when a high-temperature load is placed inside a chilling chamber of the refrigerator. An infrared sensor is installed at the front of the nozzle, and senses the high-temperature load region while being rotated with the nozzle. A moisture removing device is formed at a side of the nozzle, and jets cold air on the surface of the infrared sensor to remove moisture condensed on the surface of the infrared sensor.

The cold air jet opening is formed at a side of the nozzle in order to jet cold air of the cold air guide path to the high-temperature load region, and a sensor receiving groove, that receives the infrared sensor, is formed to be parallel with the cold air jet opening on the side of the nozzle.

The moisture removing device is a cold air discharge opening connecting the sensor receiving groove with the cold air jet opening, the cold air discharge opening jetting part of the cold air passing through the cold air jet opening onto the sensor receiving aperture.

The cold air discharge aperture is a slot-shaped hole.

The slot-shaped hole of the cold air discharge hole has the same length as a length of a side of the infrared sensor.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Hereinafter the preferred embodiment of a refrigerator having a concentrated cooling apparatus in accordance with the present invention will be described.

There are plural embodiments of a refrigerator having a concentrated cooling apparatus in accordance with the present invention, hereinafter, the preferred embodiment will be described.

Figure 1:
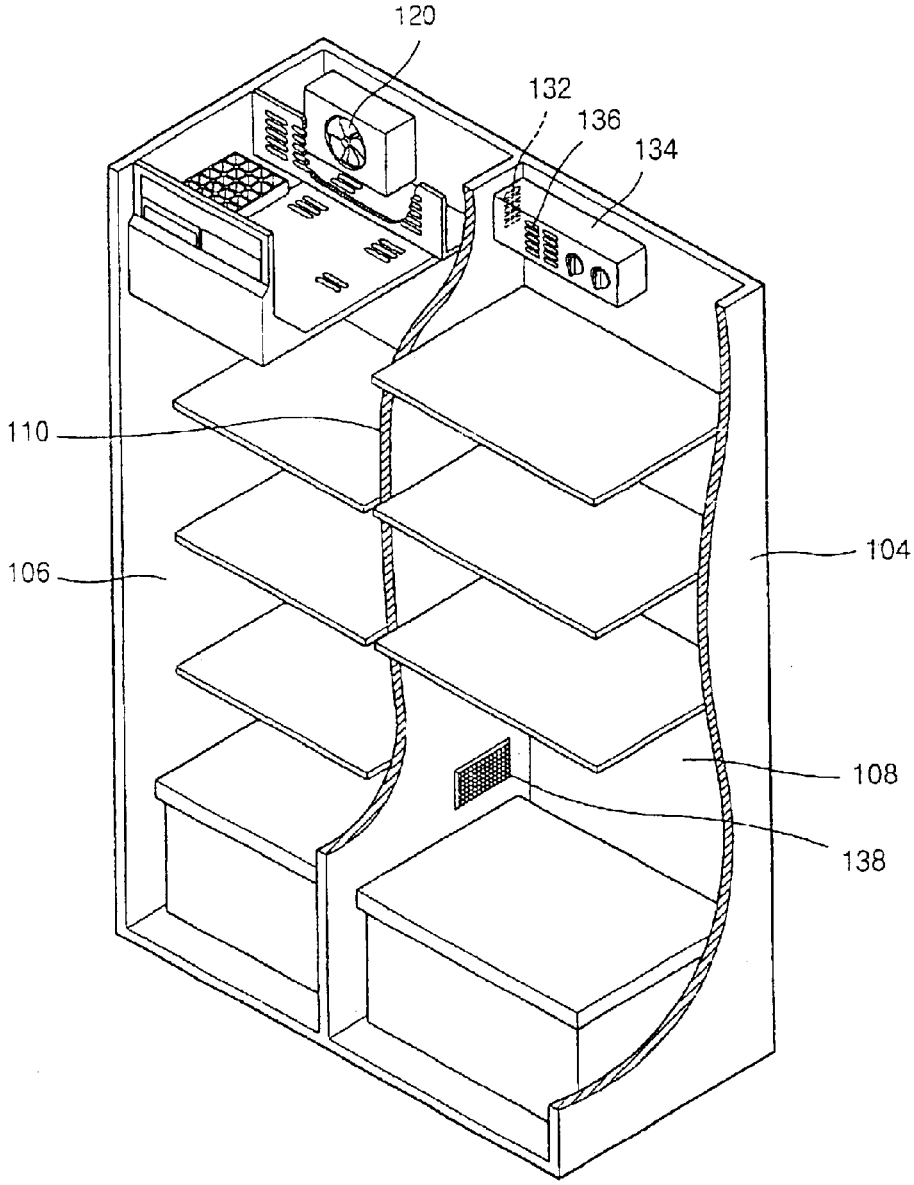
FIG. 1 CONVENTIONAL ART
FIG. 1 is a partial-perspective view illustrating the conventional refrigerator.
Figure 2:
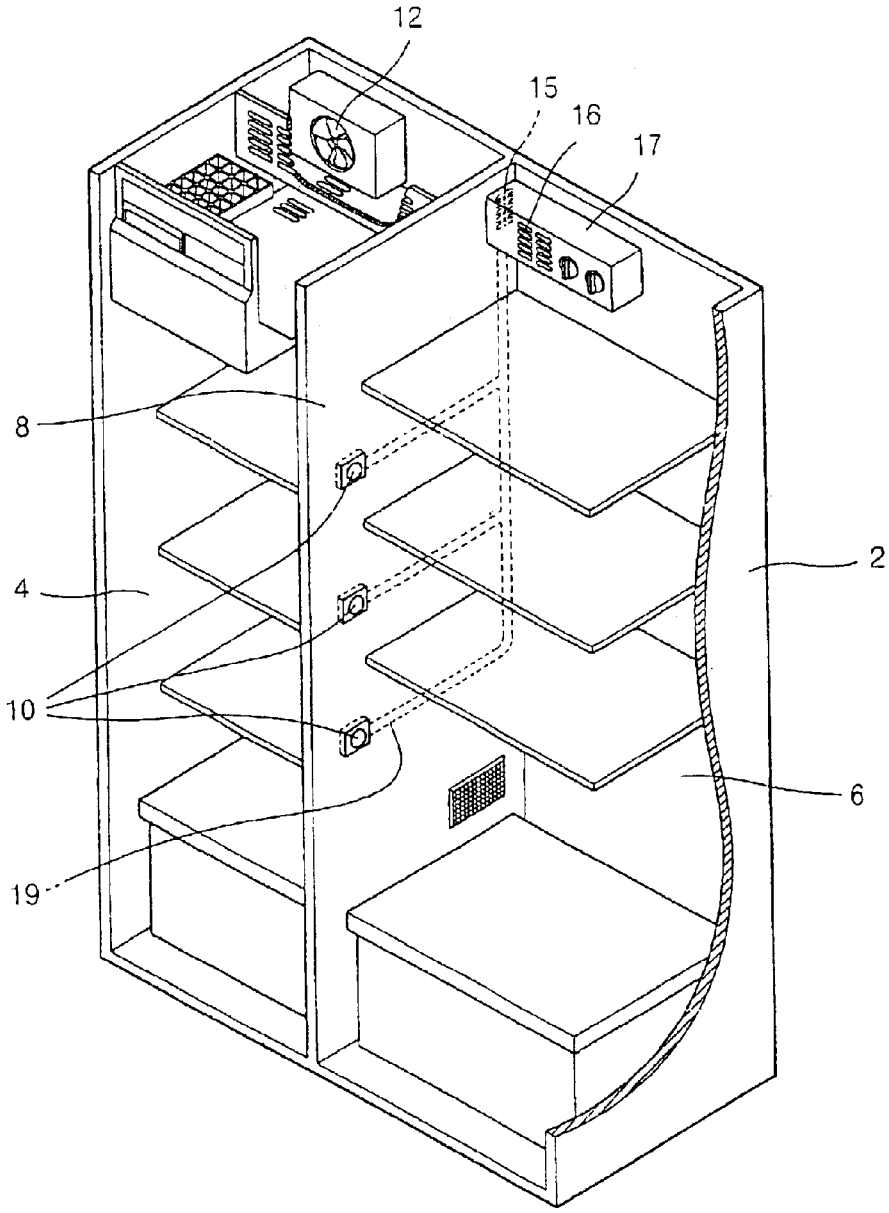
FIG. 2 is a partial-perspective view illustrating a refrigerator having a concentrated cooling apparatus in accordance with the present invention.

FIG. 2 is a partial-perspective view illustrating a refrigerator having a concentrated cooling apparatus in accordance with the present invention.

The refrigerator in accordance with the present invention includes a main body 2 having a storing space in which foodstuff is stored and a fan 12 installed at the upper rear surface of a freezing chamber 4 arranged on the right side of the main body 2 and forcibly circulating an air cooled while passing a refrigerant through a cycle. A cold air supply path 15 is formed at the upper portion of a separation wall 8 partitioning the main body 2 into the freezing chamber 4 and a chilling or refrigerating chamber 6 to make cold air sent by the fan 120 flow into the chilling chamber 6. A cold air discharge duct 17 communicating with the cold air supply path 15, is installed at the upper portion of the chilling chamber 6 and is provided with a cold air discharge opening 16 for discharging cold air into the chilling chamber 6. A concentrated cooling apparatus 10 for intensively discharging cold air onto a high-temperature load region in the chilling chamber 6 is also provided.

Figure 3:
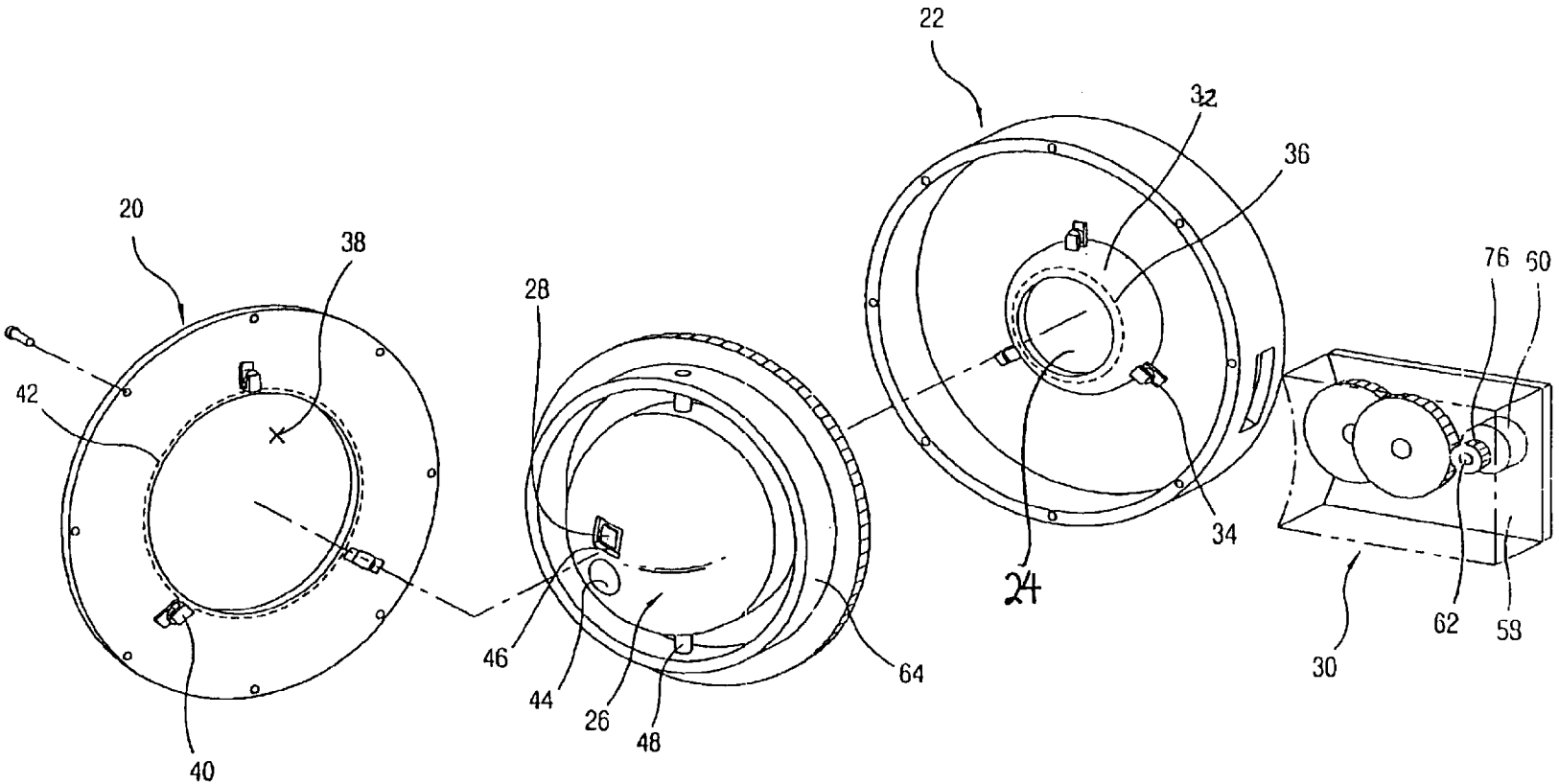
FIG. 3 is an exploded perspective view illustrating the concentrated cooling apparatus in accordance with the present invention.
Figure 4:
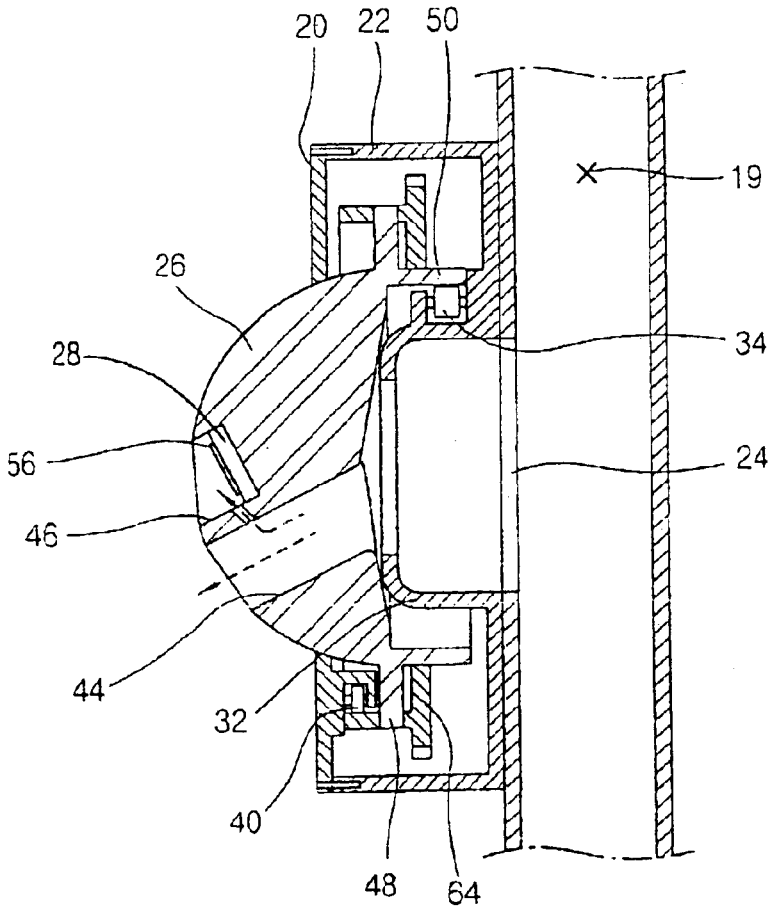
FIG. 4 is a sectional view illustrating the concentrated cooling apparatus in accordance with the present invention.
Figure 5:
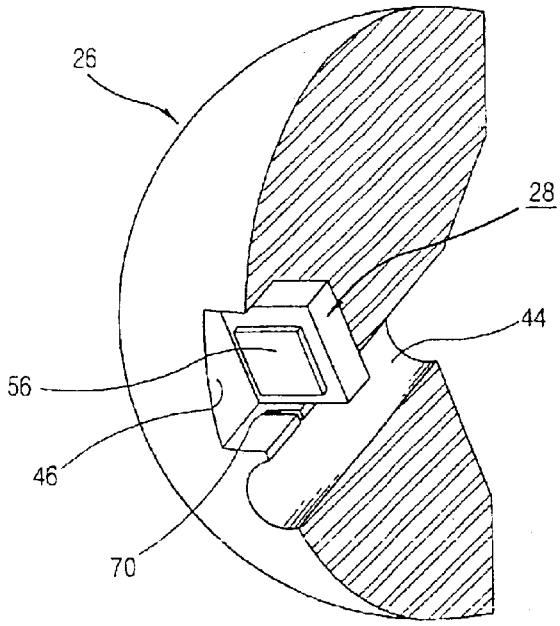
FIG. 5 is a partially-sectional perspective view illustrating a nozzle of the concentrated cooling apparatus in accordance with the present invention.

FIG. 3 is an exploded perspective view illustrating the concentrated cooling apparatus in accordance with the present invention, and FIG. 4 is a partial sectional view illustrating the concentrated cooling apparatus in accordance with the present invention.

The concentrated cooling apparatus 10 includes at least one cold air guide path 19 extending from the cold air supply path 15, formed at the side wall of the chilling chamber 6 and guiding cold air to the side wall of the chilling chamber 6. Upper and lower housings 20, 22 are respectively formed in a length direction of the cold air guide path 19 and have a cold air guide opening 24 for discharging cold air. A nozzle 26 is rotationally installed inside the upper and lower housings 20, 22 and jets cold air to a high-temperature load region. An infrared sensor 28 is installed at the front of the nozzle 26 and senses the high-temperature load region in the chilling chamber 6' while being rotated together with the nozzle 26. A moisture removing device for removing moisture condensed on the surface of the infrared sensor 28, and a nozzle operating unit 30 for rotating the nozzle 26 are also provided.

The cylinder-shaped lower housing 22 has an open upper portion, and a contact protrusion 32, which contacts the nozzle 26, is formed at the center of the internal bottom surface of the lower housing 22. Plural first support rollers 34 for rotationally supporting the nozzle 26 are installed at spaced locations about the circumference of the contact protrusion 32.

Herein, the contact protrusion 32 has a through hole so as to communicate with the cold air guide hole 24 of the cold air guide path 19, the upper surface of the contact protrusion 32 is curved to facilitate the rotation in contact with the nozzle 26. A first heating-wire 36 is installed at the circumference of the contact protrusion 32 in order to protect the contact portions of the nozzle 26 and the contact protrusion 32 from frost.

The disc-shaped upper housing 20 has a nozzle insertion hole 38 at the central portion to receive the nozzle 26, and plural second support rollers 40 are installed at spaced locations about the circumference of the nozzle insertion hole 38 at regular intervals. And, a second heating-wire 42 is installed at the internal surface of the upper housing 20 in order to protect the contact portion with the nozzle 26 from frost.

The nozzle 26 has a semi-globular (i.e. semi-spherical) shape, and is inserted into the nozzle insertion hole 38 of the upper housing 20. The upper portion of the nozzle 26 extends from and is exposed from the front of the upper housing 20, and the lower inner circumference of the nozzle 26 is contacted by the contact protrusion 32 of the lower housing 22.

A cold air jet hole or opening 44 is formed at the nozzle 26 to jet cold air onto the high-temperature load region. A sensor receiving groove 46, in which the infrared sensor 28 is installed is formed at the upper surface of the nozzle 26 and extends in parallel and horizontally with respect to the cold air jet hole 44. Further, a connection rod 48 is formed at the lower portion of the nozzle 26 so as to be connected with a nozzle driving unit 30, and a cylindrical guide portion 50 rotatably supported by the first support roller 34 of the lower housing 22 is formed at the lower portion of the nozzle 26 (FIG. 4).

Herein, the infrared sensor 28 is inserted into the sensor receiving groove 46 formed at the upper surface of the nozzle 26, and an infrared lens 56 for refracting and transmitting an infrared ray is installed at the front of the infrared sensor 28 to collect (i.e. direct) infrared rays onto the infrared sensor 28.

The nozzle driving unit 30 includes a gear box 58 installed at the side of the lower housing 22; a driving motor 60 disposed in the gear box 58 and generating a driving force. A nozzle supporting member 64 is fixed by the connection rod 48 of the nozzle 26, and is connected to the driving shaft 62 and the plural gears 76 of the driving motor 60 to transmit the driving force of the driving motor 60 to the nozzle 26.

In order to remove moisture that condenses onto the surface of the infrared sensor 28, a moisture removing device that jets cold air into the sensor receiving groove 46, in which the infrared sensor 28 is installed, is formed at a side of the nozzle 26.

Figure 6:
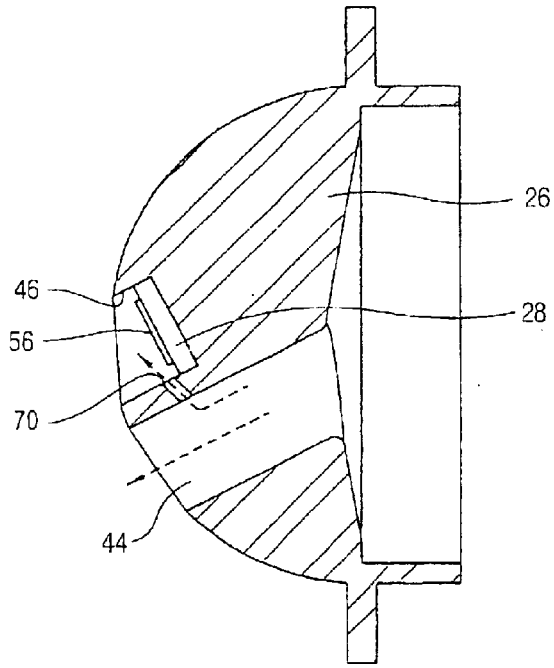
FIG. 6 is a sectional view illustrating the concentrated cooling apparatus in accordance with the present invention.

It is preferable to form the moisture removing device as a cold air discharge hole or aperture 70 (FIG. 6) connecting the sensor receiving groove 46 with the cold air jet hole 44 and discharging part of the cold air jetted through the cold air discharge hole or opening 44 onto the sensor receiving groove 46.

In more detail, because cold air jetted through the cold air jet hole or opening 44 is in the low temperature-low humidity state as a result of passing a heat exchanger (not shown), the cold air jetted onto the sensor receiving groove 46 removes moisture condensed onto the surface of the infrared sensor 28.

It is preferable for the cold air discharge hole or opening 70 to have a slot-shaped opening having the same length as a length of the side surface of the infrared sensor 56. Therefore, cold air is uniformly jetted onto the surface of the infrared sensor 28 through the slot-shaped cold air discharge opening 70, and accordingly it is possible to remove moisture virtually instantly.

The operation of the concentrated cooling apparatus in accordance with the embodiment of the present invention now will be described.

In the normal operation of the refrigerator, when a high-temperature load is placed at a certain region inside the chilling chamber 6, the infrared sensor 28, which senses temperature variations, senses the region around the high-temperature load by scanning temperature inside the chilling chamber 6. Then, according to the result of sensing the region around the high-temperature load, the control unit rotates the cold air jet hole 44 of the nozzle 26 toward the pertinent region by controlling the driving motor 60 and performs a concentrated cooling onto the high-temperature load region, and accordingly a temperature inside the chilling chamber 6 can be evenly maintained.

Further, the moisture removing device removes moisture condensed on the surface of the infrared sensor 28 due to opening/closing, etc. of the chilling chamber door by jetting cold air into the sensor receiving groove 46 in which the infrared sensor 28 is received.

In more detail, when part of cold air jetted through the cold air jet hole 44 is discharged into the sensor receiving groove 46 through the cold air discharge hole 70 which serves as the moisture removing device, the cold air in the low temperature-low humidity state removes moisture condensed on the surface of the infrared sensor 28. Accordingly it is possible to maintain the sensitivity of the infrared sensor 28 so that the infrared sensor 28 senses temperature precisely.

More particularly, when the outside air flows into the refrigerator due to the opening/closing of the refrigerator door, moisture contained in the air is condensed onto the internal surface of the chilling chamber. Herein, when the moisture is condensed on to the surface of the infrared sensor 28, sensitivity of the infrared sensor 28 may be lowered. In that case, it is impossible to sense a temperature precisely. In order to prevent this problem from occuring, in the present invention, by jetting cold air into the sensor receiving groove 46, the moisture condensed onto the surface of the infrared sensor 28 is removed.

Hereinafter, the effectiveness of the concentrated cooling apparatus of the refrigerator in accordance with the present invention will be described.

By forming a cold air discharge opening connecting a cold air jet opening with a sensor receiving groove at a side of a nozzle, part of the cold air passing through the cold air jet opening is discharged onto the sensor receiving groove, and moisture condensed onto the surface of an infrared sensor installed to the sensor receiving groove is removed. Accordingly it is possible to maintain sensitivity of the infrared sensor to sense temperature precisely.

The present disclosure relates to subject matter contained in priority Korean Application No. 2002-0043656, filed on Jul. 24, 2002, which is herein expressly incorporated by reference in its entirety.

What is claimed is:

1. A concentrated cooling apparatus of a refrigerator, comprising:

a nozzle rotationally supported by a cold air guide path, the nozzle letting cold air onto a high-temperature load region when a high-temperature load is placed inside a chilling chamber of the refrigerator;

an infrared sensor installed at the front of the nozzle, the infrared sensor sensing the high-temperature load region while being rotated with the nozzle;

a moisture removing device provided at a side of the nozzle, the moisture removing device jetting cold air on the surface of the infrared sensor to remove moisture condensed on the surface of the infrared sensor;

a cold air jet opening provided at a side of the nozzle to jet cold air of the cold air guide path to the high-temperature load region; and a sensor receiving groove that receives the infrared sensor is provided parallel with the cold air jet opening on the side of the nozzle, wherein the moisture removing device comprises a cold air discharge opening connecting the sensor receiving groove with the cold air jet opening, and the cold air discharge opening jets part of the cold air passing through the cold air jet opening onto the sensor receiving groove.

2. The apparatus of claim 1, wherein the cold air discharge opening is a slot-shaped opening.

3. The apparatus of claim 1, wherein the slot-shaped opening comprises of the cold air discharge opening has the same length as a length of a side of the infrared sensor.

4. A concentrated cooling apparatus of a refrigerator, comprising:

a nozzle rotationally supported by a cold air guide path, the nozzle jetting cold air onto a high-temperature load region when a high-temperature load is placed inside a chilling chamber of the refrigerator;

an infrared sensor installed at the front of the nozzle, the infrared sensor sensing the high-temperature load region while being rotated with the nozzle;

a moisture removing device provided at a side of the nozzle, the moisture removing device letting cold air on the surface of the infrared sensor to remove moisture condensed on the surface of the infrared sensor; and a disc-shaped upper housing and a cylinder-shaped lower housing respectively positioned along in a length direction of the cold air guide path, the disc-shaped upper housing and the cylinder-shaped lower housing having a cold air guide opening that discharges cold air, wherein at least one of the cold air guide path extends from a cold air supply path, is formed at a side wall of the chilling chamber and guides cold air to the side wall of the chilling chamber; and a nozzle operating unit that rotates the nozzle.

5. The apparatus of claim 4, wherein the cylinder-shaped lower housing has an open upper portion, a contact protrusion being positioned at the center of an interior bottom surface of the cylinder-shaped lower housing, said contact protrusion contacting the nozzle and a plurality of first support rollers that supporting the nozzle for rotation are positioned about the circumference of the contact protrusion.

6. The apparatus of claim 5, wherein the contact protrusion has a through hole so as to communicate with the cold air guide hole of the cold air guide path, the upper surface of the contact protrusion being curved to enable rotation in contact with the nozzle, and a first hot-wire is provided at the circumference of the contact protrusion to prevent frost from forming in the contact portions of the nozzle and the contact protrusion.

7. The apparatus of claim 4, wherein the disc-shaped upper housing comprises a nozzle insertion opening at a central portion to receive the nozzle, a plurality of support rollers are positioned about the circumference of the nozzle insertion opening at regular intervals, and a second hot-wire is provided at an internal surface of the upper housing in order to prevent frost from forming on a portion of the upper housing that contacts the nozzle.

8. The apparatus of claim 4, wherein the nozzle has a semi-spherical shape, and is inserted into a nozzle insertion opening of the disc-shaped upper housing, an upper portion of the nozzle being exposed to the front of the upper housing, and a lower inner circumference of the nozzle is in contact with a contact protrusion of the cylinder-shaped lower housing.

9. The apparatus of claim 8, wherein a cold air jet opening is formed at the nozzle to jet cold air onto the high-temperature load region, a sensor receiving groove in which the infrared sensor is positioned is formed at the upper surface of the nozzle parallel with the cold air jet opening, a connection rod being integrally provided at the lower portion of the nozzle so as to be connected with a nozzle driving unit, and a cylindrical guide portion rotationally supported by a first support roller of the cylinder-shaped lower housing is provided at the lower portion of the nozzle.

10. The apparatus of claim 9, wherein the infrared sensor is positioned in the sensor receiving groove formed at the upper surface of the nozzle, and an infrared lens for refracting transmitted infrared rays is provided at the front of the infrared sensor to direct infrared rays onto the infrared sensor.

11. The apparatus of claim 10, wherein the nozzle driving unit comprises:

a gear box provided at a side of the lower housing;

a driving motor disposed in the gear box and generating a driving force; and a nozzle supporting member secured to the connection rod of the nozzle and connected to a plurality of gears and to a driving shaft of the driving motor to transmit driving force of the driving motor to the nozzle.

* * * * *

UNITED STATES PATENT AND TRADEMARK OFFICE

CERTIFICATE OF CORRECTION

PATENT NO. : 6,837,066 B2
DATED : January 4, 2005
INVENTOR(S) : S. H. Cho et al.

It is certified that error appears in the above-identified patent and that said Letters Patent is hereby corrected as shown below:

Column 5,
Line 49, “letting” should be -- jetting --.

Column 6,
Line 20, “letting” should be -- jetting --.

Signed and Sealed this

Thirteenth Day of September, 2005

JON W. DUDAS
*Director of the United States Patent and Trademark Office*